US007372005B2

(12) United States Patent
Knoeppel et al.

(10) Patent No.: US 7,372,005 B2
(45) Date of Patent: May 13, 2008

(54) WATER STORAGE DEVICE HAVING A POWERED ANODE

(75) Inventors: Ray Oliver Knoeppel, Hartland, WI (US); Thomas Gerard Van Sistine, Menomonee Falls, WI (US); Mark Allan Murphy, Nashville, TN (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 10/950,851

(22) Filed: Sep. 27, 2004

(65) Prior Publication Data

US 2006/0083491 A1 Apr. 20, 2006

(51) Int. Cl.
*H05B 1/02* (2006.01)
*F24H 1/20* (2006.01)
*G01N 27/02* (2006.01)

(52) U.S. Cl. ..... 219/497; 219/494; 392/457; 392/338; 392/441; 204/196.06; 324/439

(58) Field of Classification Search ..... 392/457, 392/312, 311; 219/497; 204/196.06; 324/439
See application file for complete search history.

(56) References Cited

U.S. PATENT DOCUMENTS 3,132,082 A 5/1964 Overmyer
3,135,677 A 6/1964 Fischer
3,424,665 A 1/1969 Matthews
4,087,742 A 5/1978 Khoo
4,136,001 A 1/1979 Nozaki
4,231,852 A * 11/1980 Ruckert ..... 204/196.02
4,311,576 A 1/1982 Toudo et al.
4,343,987 A * 8/1982 Schimbke et al. ..... 392/312
4,347,430 A * 8/1982 Howard-Leicester et al. ..... 392/312
4,407,711 A 10/1983 Baboian et al.
4,434,039 A 2/1984 Baboian et al.
4,692,591 A * 9/1987 Cooley et al. ..... 392/312
4,755,267 A * 7/1988 Saunders ..... 205/726
4,972,066 A 11/1990 Houle et al.
4,975,560 A 12/1990 Wardy et al.
5,023,928 A 6/1991 Houlde et al.
5,176,807 A * 1/1993 Kumar ..... 204/196.06

(Continued)

FOREIGN PATENT DOCUMENTS

DE 35 32 058 3/1987

(Continued)

*Primary Examiner*—Tu Ba Hoang
*Assistant Examiner*—Stephen J. Ralis
(74) *Attorney, Agent, or Firm*—Michael Best & Friedrich LLP

(57) ABSTRACT

A water heater having a powered electrode and a method of controlling the water heater. The water heater includes a tank to hold water, a heating element, an electrode, and a control circuit. The control circuit includes a variable voltage supply, a voltage sensor, and a current sensor. The control circuit is configured to controllably apply a voltage to the electrode, determine the potential of the electrode relative to the tank with the voltage sensor when the voltage does not power the electrode, determine a current applied to the tank after the voltage powers the electrode, determine a conductivity state of the water in the tank based on the electrode potential and the current, and define the voltage applied to the powered electrode based on the conductivity state. The control circuit of the water heater can also determine whether the water heater is in a dry-fire state.

10 Claims, 3 Drawing Sheets

U.S. PATENT DOCUMENTS

| | | | | | |
|---|---|---|---|---|---|
| 5,260,663 | A | * | 11/1993 | Blades | 324/442 |
| 5,287,060 | A | * | 2/1994 | Reddy et al. | 324/439 |
| 5,342,493 | A | | 8/1994 | Boiko | |
| 5,445,719 | A | | 8/1995 | Boiko | |
| 5,504,430 | A | * | 4/1996 | Andersson | 324/439 |
| 5,831,250 | A | * | 11/1998 | Bradenbaugh | 219/497 |
| 5,872,454 | A | * | 2/1999 | West | 324/439 |
| 5,949,960 | A | | 9/1999 | Hall | |
| 6,080,973 | A | * | 6/2000 | Thweatt, Jr. | 219/497 |
| 6,437,300 | B1 | * | 8/2002 | Katzman et al. | 219/497 |
| 6,455,820 | B2 | | 9/2002 | Bradenbaugh | |
| 6,478,947 | B2 | * | 11/2002 | Nagasaku et al. | 205/695 |
| 6,506,295 | B1 | * | 1/2003 | Takahashi et al. | 205/725 |
| 6,522,834 | B1 | * | 2/2003 | Herrick et al. | 392/311 |
| 6,529,841 | B2 | * | 3/2003 | Cocking et al. | 702/65 |
| 6,690,172 | B2 | * | 2/2004 | Higo | 324/439 |
| 6,690,173 | B2 | * | 2/2004 | Blades | 324/439 |
| 6,795,644 | B2 | * | 9/2004 | Bradenbaugh | 392/463 |
| 6,871,014 | B2 | * | 3/2005 | Pierre | 392/457 |
| 6,930,486 | B2 | * | 8/2005 | Muscarella et al. | 324/446 |
| 2003/0164708 | A1 | * | 9/2003 | Park et al. | 324/439 |
| 2005/0006251 | A1 | * | 1/2005 | Thomas et al. | 205/725 |

FOREIGN PATENT DOCUMENTS

| | | | | |
|---|---|---|---|---|
| DE | 3916847 | | | 11/1990 |
| DE | 19609892 | A1 | * | 9/1997 |
| DE | 101 45 575 | | | 4/2003 |
| EP | 1426467 | | | 6/2004 |
| GB | 1423959 | | | 2/1976 |
| JP | 59035686 | A | * | 2/1984 |
| JP | 62228494 | A | * | 10/1987 |
| JP | 08176858 | A | * | 7/1996 |

* cited by examiner

WATER STORAGE DEVICE HAVING A POWERED ANODE

BACKGROUND

The invention relates to a water storage device having a powered anode and a method of controlling the water storage device.

Powered anodes have been used in the water heater industry. To operate properly, a powered anode typically has to resolve two major concerns. First, the powered anode should provide enough protective current to protect exposed steel within the tank. The level of exposed steel will vary from tank to tank and will change during the lifetime of the tank. Second, the protective current resulting from the powered anode should be low enough to reduce the likelihood of excessive hydrogen.

There are at least two techniques currently available in the water heater industry for using a powered anode to protect a tank. One technique adjusts anode voltage levels based on the conductivity of the water. However, this technique does not measure the protection level of the tank and tanks with excessive exposed steel could be inadequately protected. The second technique periodically shuts off the current to the anode electrode and uses the electrode to "sense" the protection level of the tank. This technique adapts to the changing amount of exposed steel in the tank, but does not adapt to changing water conductivity levels. In addition, this technique can have problems in high conductivity waters since currently produced titanium electrodes with mixed metal oxide films have a tendency to drift in their reference voltage measurements in high conductivity water. It would be beneficial to have another alternative to the just-described techniques.

SUMMARY

In one embodiment, the invention provides a water heater including a tank to hold water, an inlet to introduce cold water into the tank, an outlet to remove hot water from the tank, a heating element (e.g., an electric resistance heating element or a gas burner), an electrode, and a control circuit. The control circuit includes a variable voltage supply, a voltage sensor, and a current sensor. The control circuit is configured to controllably apply a voltage to the electrode, determine a potential of the electrode relative to the tank when the voltage does not power the electrode, determine a current applied to the tank after the voltage powers the electrode, determine a conductivity state of the water in the tank based on the applied voltage and the current, and define the voltage applied to the electrode based on the conductivity state.

In another embodiment, the invention provides a method of controlling operation of a water storage device. The method includes the acts of applying a voltage to an electrode, ceasing the application of the applied voltage to the electrode, determining the potential of the electrode relative to the tank after the ceasing of the application of the applied voltage, determining a conductivity state of the water, defining a target potential for the electrode based on the conductivity state, and adjusting the applied voltage to have the electrode potential emulate the target potential.

In another embodiment, the invention provides another method of controlling operation of a water heater. The method includes the acts of applying a voltage to an electrode, acquiring a signal having a relation to the applied voltage, determining whether the water heater is in a dry-fire state based at least in part on the acquired signal, and preventing activation of a heating element when the water heater is in a dry-fire state.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected," "supported," and "coupled" are used broadly and encompass both direct and indirect mounting, connecting, supporting, and coupling. Further, "connected" and "coupled" are not restricted to physical or mechanical connections or couplings, and can include electrical connections or couplings, whether direct or indirect.

Figure 1:
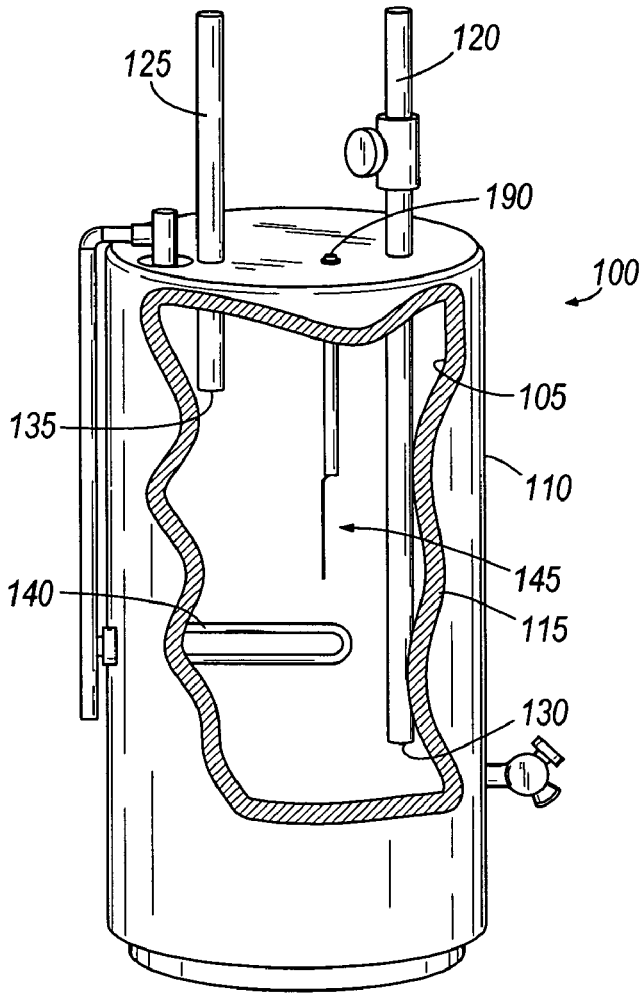
FIG. 1 is partial-exposed view of a water heater embodying the invention.

FIG. 1 illustrates a water heater 100 including an enclosed water tank 105, a shell 110 surrounding the water tank 105, and foam insulation 115 filling the annular space between the water tank 105 and the shell 110. A typical storage tank 105 is made of ferrous metal and lined internally with a glass-like porcelain enamel to protect the metal from corrosion. Nevertheless, the protective lining may have imperfections or, of necessity, may not entirely cover the ferrous metal interior. Under these circumstances, an electrolytic corrosion cell may be established as a result of dissolved solids in the stored water, leading to corrosion of the exposed ferrous metal and to reduction of service life for the water heater 100.

A water inlet line or dip tube 120 and a water outlet line 125 enter the top of the water tank 105. The water inlet line 120 has an inlet opening 130 for adding cold water to the water tank 105, and the water outlet line 125 has an outlet opening 135 for withdrawing hot water from the water tank 105. The water heater 100 also includes an electric resistance heating element 140 that is attached to the tank 105 and extends into the tank 105 to heat the water. The heating element 140 typically includes an internal high resistance heating element wire surrounded by a suitable insulating material and enclosed in a metal jacket. Electric power for the heating element 140 is typically supplied from a control circuit. While a water heater 100 having element 140 is shown, the invention can be used with other water heater types, such as a gas water heater, and with other water heater element designs. It is also envisioned that the invention or aspects of the invention can be used in other water storage devices.

Figure 2:
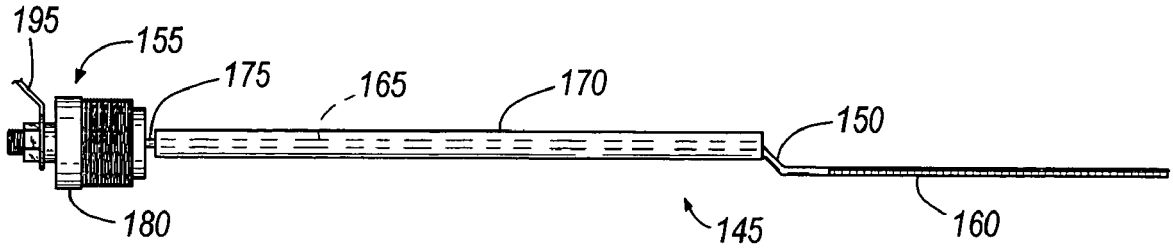
FIG. 2 is a side view of an electrode capable of being used in the water heater of FIG. 1.

An electrode assembly 145 is attached to the water heater 100 and extends into the tank 105 to provide corrosion protection to the tank. An example electrode assembly 145 capable of being used with the water heater is shown in FIG. 2. With reference to FIG. 2, the electrode assembly 145 includes an electrode wire 150 and a connector assembly 155. The electrode wire 150 comprises titanium and has a first portion 160 that is coated with a metal-oxide material and a second portion 165 that is not coated with the metal-oxide material. During manufacturing of the electrode assembly 145, a shield tube 170, comprising PEX or polysulfone, is placed over a portion of the electrode wire 150. The electrode wire 150 is then bent twice (e.g., at two forty-five degree angles) to hold the shield tube in place. A small portion 175 of the electrode wire 150 near the top of the tank is exposed to the tank for allowing hydrogen gas to exit the shield tube. In other constructions, the electrode assembly 145 does not include the shield tube 170. The connector assembly 155 includes a spud 180 having threads, which secure the electrode rod assembly to the top of the water tank 105 by mating with the threads of opening 190 (FIG. 1). Of course, other connector assemblies known to those skilled in the art can be used to secure the electrode assembly 145 to the tank 105. The connector assembly also includes a connector 195 for electrically connecting the electrode wire 150 to a control circuit (discussed below). Electrically connecting the electrode assembly 145 to the control circuit results in the electrode assembly 145 becoming a powered anode. As is known to those skilled in the art, the electrode wire 150 is electrically isolated from the tank 105 to allow for a potential to develop across the electrode wire 150 and the tank 105.

Figure 3:
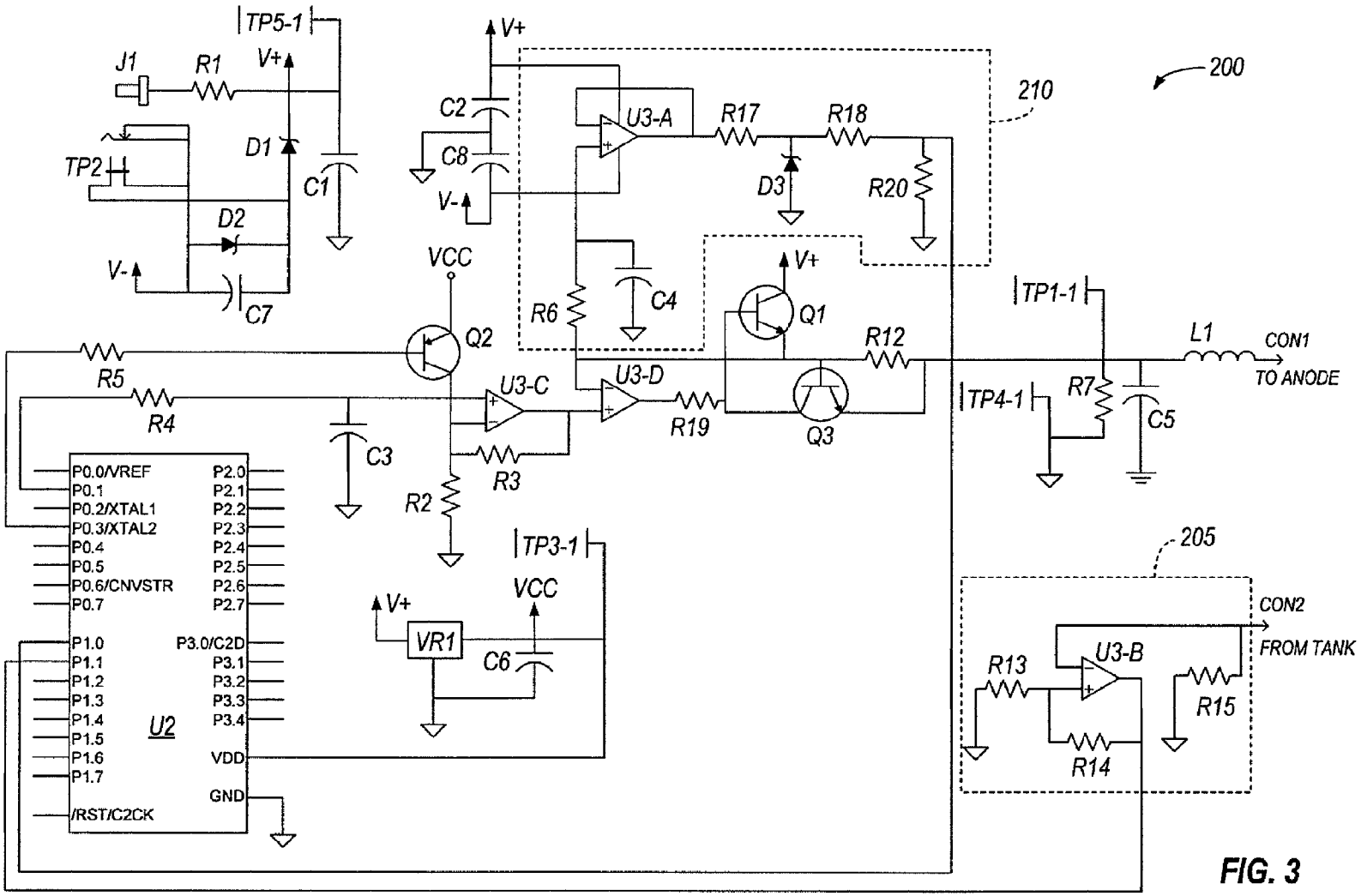
FIG. 3 is a electric schematic of a control circuit capable of controlling the electrode of FIG. 2.

An electronic schematic for one construction of the control circuit 200 used for controlling the electrode assembly 145 is shown in FIG. 3. The control circuit includes a microcontroller U2. An example microcontroller U2 used in one construction of the control circuit 200 is a Silicon Laboratories microcontroller, model no. 8051F310. As will be discussed in more detail below, the microcontroller U2 receives signals or inputs from a plurality of sensors, analyzes the inputs, and generates outputs to control the electrode assembly 145. In addition, the microcontroller U2 can receive other inputs (e.g., inputs from a user) and can generate outputs to control other devices (e.g., the heating element 140). As is known in the art, the Silicon Laboratories microcontroller, model no. 8051F310, includes a processor and memory. The memory includes one or more modules having instructions. The processor obtains, interprets, and executes the instructions to control the water heater 100, including the electrode assembly 145. Although the microcontroller U2 is described having a processor and memory, the invention may be implemented with other devices including a variety of integrated circuits (e.g., an application-specific-integrated circuit) and discrete devices, as would be apparent to one of ordinary skill in the art.

The microcontroller U2 outputs a pulse-width-modulated (PWM) signal at P0.1. Generally speaking, the PWM signal controls the voltage applied to the electrode wire 150. A one hundred percent duty cycle results in full voltage being applied to the electrode wire 150, a zero percent duty cycle results in no voltage being applied to the electrode wire 150, and a ratio between zero and one hundred percent will result in a corresponding ratio between no and full voltage being applied to the electrode wire 150.

The PWM signal is applied to a low-pass filter and amplifier, which consists of resistors R2, R3, and R4; capacitor C3; and operational amplifier U3-C. The low-pass filter converts the PWM signal into an analog voltage proportional to the PWM signal. The analog voltage is provided to a buffer and current limiter, consisting of operational amplifier U3-D, resistors R12 and R19, and transistors Q1 and Q3. The buffer and current limiter provides a buffer between the microcontroller U2 and the electrode assembly 145 and limits the current applied to the electrode wire 150 to prevent hydrogen buildup. Resistor R7, inductor L1, and capacitor C5 act as a filter to prevent transients and oscillations. The result of the filter is a voltage that is applied to the electrode assembly 145, which is electrically connected to CON1.

As discussed later, the drive voltage is periodically removed from the electrode assembly 145. The microcontroller deactivates the drive voltage by controlling the signal applied to a driver, which consists of resistor R5 and transistor Q2. More specifically, pulling pin P0.3 of microcontroller U2 low results in the transistor Q1 turning OFF, which effectively removes the applied voltage from driving the electrode assembly 145. Accordingly, the microcontroller U2, the low-pass filter and amplifier, the buffer and current limiter, the filter, and the driver act as a variable voltage supply that controllably applies a voltage to the electrode assembly 145, resulting in the powered anode. Other circuit designs known to those skilled in the art can be used to controllably provide a voltage to the electrode assembly 145.

The connection CON2 provides a connection that allows for an electrode return current measurement. More specifically, resistor R15 provides a sense resistor that develops a signal having a relation to the current at the tank. Operational amplifier U3-B and resistors R13 and R14 provide an amplifier that provides an amplified signal to the microcontroller U2 at pin P1.1. Accordingly, resistor R15 and the amplifier form a current sensor 205. However, other current sensors can be used in place of the sensor just described.

With the removal of the voltage, the potential at the electrode 145 drops to a potential that is offset from, but proportional to, the open circuit or "natural potential" of the electrode 145 relative to the tank 105. A voltage proportional to the natural potential is applied to a filter consisting of resistor R6 and capacitor C4. The filtered signal is applied to operational amplifier U3-A, which acts as a voltage follower. The output of operational amplifier U3-A is applied to a voltage limiter (resistor R17 and zener diode D3) and a voltage divider (resistor R18 and R20). The output is a signal having a relation to the natural potential of the electrode assembly 145, which is applied to microcontroller U2 at pin P1.0. Accordingly, the just-described filter, voltage follower, voltage limiter, and voltage divider form a voltage sensor 210. However, other voltage sensors can be used in place of the disclosed voltage sensor.

The control circuit 200 controls the voltage applied to the electrode wire 150. As will be discussed below, the control circuit 200 also measures tank protection levels, adapts to changing water conductivity conditions, and adapts to electrode potential drift in high conductivity water. In addition, when the control circuit 200 for the electrode assembly 145 is combined or in communication with the control circuit for the heating element 140, the resulting control circuit can take advantage of the interaction to provide additional control of the water heater.

Figure 4:
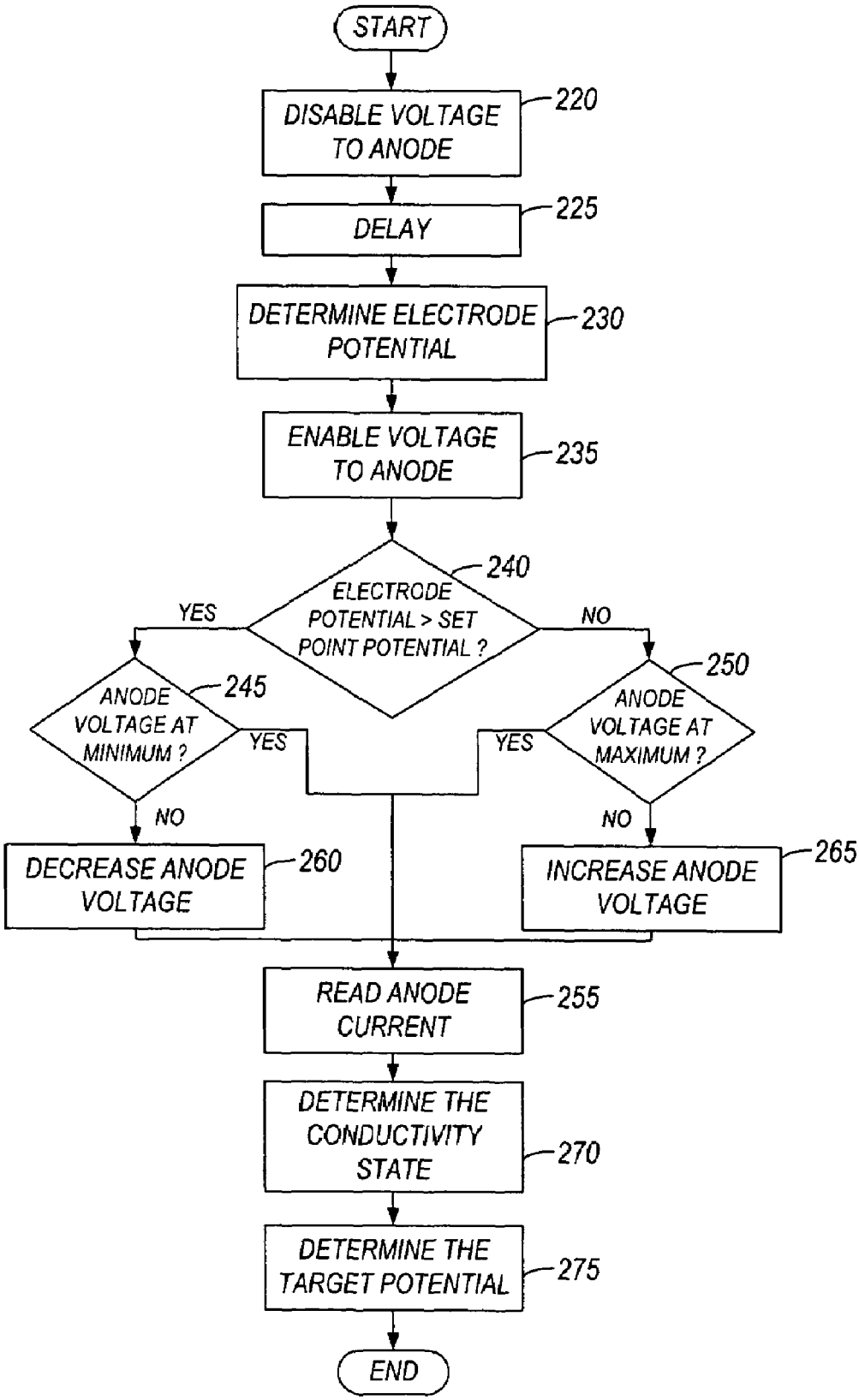
FIG. 4 is a flow chart of a subroutine capable of being executed by the control circuit shown in FIG. 3.

FIG. 4 provides one method of controlling the electrode assembly 145. Before proceeding to FIG. 4, it should be understood that the order of steps disclosed could vary.

Furthermore, additional steps can be added to the control sequence and not all of the steps may be required. During normal operation, voltage is applied from the control circuit 200 to the electrode assembly 145. Periodically (e.g., every 100 ms), an interrupt occurs and the control circuit enters the control loop shown in FIG. 4.

With reference to FIG. 4, the control circuit 200 disables the voltage applied to the electrode assembly 145 (block 220). After disabling the voltage, the control circuit 200 performs a delay (block 225), such as 250 μs, and determines an electrode potential (block 230). The control circuit 200 performs the delay to allow the electrode assembly 145 to relax to its open circuit. The microcontroller U1 then acquires this potential from the voltage sensor 210. The control circuit 200 then reapplies the voltage to the electrode assembly 145 (block 240). At block 240, the control circuit 200 determines whether the electrode potential is greater than a target potential. If the electrode potential is greater than the target potential, the control circuit proceeds to block 245; otherwise the control proceeds to block 250.

At block 245, the control circuit 200 determines whether the applied voltage is at a minimum value. If the applied voltage is at the minimum, the control circuit 200 proceeds to block 255; otherwise the control circuit 200 proceeds to block 260. At block 260, the control circuit decreases the applied voltage.

At block 250, the control circuit 200 determines whether the applied voltage is at a maximum value. If the applied voltage is at the maximum, the control circuit 200 proceeds to block 255; otherwise the control circuit proceeds to block 265. At block 265, the control circuit 200 increases the applied voltage. By decreasing or increasing the applied voltage at block 260 or 265, respectively, the control circuit 200 can indirectly adjust the electrode potential. Increasing the applied voltage will result in an increase in the tank potential measured by the electrode and decreasing the applied voltage will decrease the tank potential measured by the electrode. Therefore, the control circuit 200 can adjust the open circuit potential of the electrode until it reaches the target potential. Furthermore, as the characteristics of the water heater 100 change, the control circuit 200 can adjust the voltage applied to the electrode to have the open circuit potential of the electrode equal the target point potential.

At block 255, the control circuit acquires an electrode current. More specifically, the microcontroller U1 receives a signal that represents a sensed current form the current sensor 205. At block 270, the control circuit determines a conductivity state of the water. For example, the conductivity state can be either a high conductivity for the water or a low conductivity for the water. To determine the conductivity state (either high or low), the microcontroller U1 divides the applied current by an incremental voltage, which is equal to the applied voltage minus the open circuit potential. If the resultant is less than an empirically set value, then the control circuit 200 determines the conductivity state is low and sets the target potential to a first value; otherwise the control circuit sets the target potential to a second value indicating a high conductivity state (block 275). The control circuit 200 can repeatedly perform the conductivity test during each interrupt (as shown in FIG. 4), periodically perform the conductivity test at a greater interval than the setting of the electrode voltage, or perform the conductivity test only during a startup sequence. Additionally, while only two set points are shown, it is envisioned that multiple set points can be used. It is also envisioned that other methods can be used to determine the conductivity state of the water. For example, a ratio of the applied current divided by the applied voltage can be used to determine the conductivity state.

In addition to establishing a set point, the control circuit 200 can use the acquired current to determine whether the water heater 100 is in a dry-fire state. The term "dry fire" refers to the activation of a water heater that is not storing a proper amount of water. Activation of a heating element (e.g., an electric resistance heating element or a gas burner) of a water heater in a dry-fire state may result in damage to the water heater. For example, if water is not properly surrounding the electric resistance heating element 140, then the electric resistance heating element may burnout in less than a minute when voltage is applied to the heating element 140. Therefore, it is beneficial to reduce the likelihood of activating the heating element 140 if the water heater 100 is in a dry-fire state. If the acquired current is less than a minimum value (e.g., essentially zero), then it is assumed that the water heater 100 is not storing the proper amount of water and the control circuit 200 prevents the activation of the heating element 140. It is also envisioned that other methods for determining a dry-fire state can be used. For example, the control circuit 200 can be designed in such a fashion that the electrode potential will be approximately equal to the applied voltage under dry fire conditions.

Thus, the invention provides, among other things, a new and useful water heater and method of controlling a water heater. Various features and advantages of the invention are set forth in the following claims.

What is claimed is:

1. A method of controlling, with a controller, the operation of a storage-type water heater, the water heater including a tank for storing water while the water is being heated to a set point temperature, the tank comprising a ferrous metal and a lining coupled to the ferrous metal, a portion of the ferrous metal being exposed to the water, the water heater further including an electrode at least partially disposed in the tank, the method comprising the steps of:

applying a voltage to the electrode having a first location, the voltage having an amplitude;

ceasing the application of the applied voltage to the electrode;

determining the potential of the electrode relative to a second location after the ceasing of the application of the applied voltage;

modifying the amplitude of the voltage to have the potential of the electrode relative to the second location emulate a target potential of the electrode relative to the second location, the target potential having a value;

applying the modified voltage to the electrode;

determining an indication of an electrical conductivity of a system including the electrode, the water, and the tank;

modifying the value of the target potential based on the indication; and repeating the above steps of the method.

2. A method as set forth in claim 1 wherein the method further comprises determining a current applied to the tank resulting from the applied voltage, wherein the determining an indication of an electrical conductivity is based at least in part on the applied voltage and the applied current.

3. A method as set forth in claim 1 wherein the method further comprises determining a current applied to the tank resulting from the applied voltage, wherein the determining an indication of an electrical conductivity comprises the acts of dividing one of the applied voltage and the applied current by the other of the applied voltage and the applied current.

4. A method as set forth in claim 3 wherein the determining a an indication of an electrical conductivity further comprises determining whether the resultant indicates a first electrical conductivity indication or a second electrical conductivity indication.

5. A method as set forth in claim 4 wherein the modifying the value of the target potential comprises setting the value of the target potential to a first value if the electrical conductivity indication is a first electrical conductivity indication and setting the value of the target potential to a second value if the electrical conductivity indication is a second electrical conductivity indication.

6. A method as set forth in claim 1 wherein the method further comprises acquiring a current applied to the tank resulting from the applied voltage, wherein the determining an indication of an electrical conductivity includes the acts of calculating a difference voltage with the applied voltage and the electrode potential relative to the tank and dividing one of the difference voltage and the applied current by the other of the difference voltage and the applied current.

7. A method as set forth in claim 6 wherein the determining a an indication of an electrical conductivity further comprises determining whether the resultant indicates a first electrical conductivity indication or a second electrical conductivity indication.

8. A method as set forth in claim 7 wherein the modifying the value of the target potential comprises setting the value of the target potential to a first value if the electrical conductivity indication is a first electrical conductivity indication and setting the value of the target potential to a second value if the electrical conductivity indication is a second electrical conductivity indication.

9. A method as set forth in claim 1 wherein the determining an indication of an electrical conductivity includes determining the indication from among a plurality of discrete indications of an electrical conductivity.

10. A method as set forth in claim 1 wherein the second location includes the tank.

* * * * *